US009457220B2

(12) United States Patent
Olson

(10) Patent No.: US 9,457,220 B2
(45) Date of Patent: Oct. 4, 2016

(54) PUSH ACTUATED POSITIONAL ADJUSTMENT OF STRENGTH MACHINES

(71) Applicant: ICON Health & Fitness, Inc., Logan, UT (US)

(72) Inventor: Micheal L. Olson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

(21) Appl. No.: 14/575,748

(22) Filed: Dec. 18, 2014

(65) Prior Publication Data

US 2015/0182780 A1 Jul. 2, 2015

Related U.S. Application Data

(60) Provisional application No. 61/922,651, filed on Dec. 31, 2013.

(51) Int. Cl.

| | |
|---|---|
| ***A63B 21/04*** | (2006.01) |
| ***A63B 21/00*** | (2006.01) |
| ***A63B 21/005*** | (2006.01) |
| ***A63B 21/02*** | (2006.01) |

(Continued)

(52) U.S. Cl.

CPC ..... *A63B 21/156* (2013.01); *A63B 21/0051* (2013.01); *A63B 21/023* (2013.01); *A63B 21/062* (2013.01); *A63B 21/153* (2013.01); *A63B 21/225* (2013.01); *A63B 21/4029* (2015.10); *A63B 21/4035* (2015.10); *A63B 21/4043* (2015.10); *A63B 2225/09* (2013.01); *A63B 2225/093* (2013.01)

(58) Field of Classification Search

CPC ..... A63B 21/00069; A63B 21/00072; A63B 21/0051; A63B 21/0052; A63B 21/023; A63B 21/025; A63B 21/045; A63B 21/0455; A63B 21/05; A63B 21/062; A63B 21/0622; A63B 21/0624; A63B 21/0626; A63B 21/0628; A63B 21/063; A63B 21/0632; A63B 21/08; A63B 21/15; A63B 21/151; A63B 21/153; A63B 21/154; A63B 21/156; A63B 21/157; A63B 21/159; A63B 21/22; A63B 21/225; A63B 21/227; A63B 21/4027; A63B 21/4033; A63B 21/4035; A63B 21/4043; A63B 21/4045; A63B 21/4047; A63B 21/4049; A63B 23/12; A63B 23/1209; A63B 23/1245; A63B 23/1281; A63B 2225/09; A63B 2225/093

See application file for complete search history.

(56) References Cited

U.S. PATENT DOCUMENTS 3,495,824 A * 2/1970 Cuinier ..... A63B 21/00072 482/113

4,327,713 A * 5/1982 Okazaki ..... A61H 23/0254 601/134

(Continued)

*Primary Examiner* — Oren Ginsberg
*Assistant Examiner* — Gary D Urbiel Goldner
(74) *Attorney, Agent, or Firm* — Holland & Hart LLP

(57) ABSTRACT

An exercise machine including an adjustable joint with a first part and a second part that are shaped to rotate with respect to each other such that when an orientation between the first part and the second part changes, a position of the user contact feature also changes. The machine also includes a locking mechanism that is positioned to secure the first part and the second part together. The locking mechanism being positioned to secure the first part and the second part in an axial locking direction and to release the first part from the second part in an axial release direction. When the first part and the second part are secured, at least two first part features are interlocked with at least two second part features simultaneously.

19 Claims, 8 Drawing Sheets

(51) Int. Cl.
*A63B 21/062* (2006.01)
*A63B 21/22* (2006.01)

(56) References Cited

U.S. PATENT DOCUMENTS 4,374,588 A * 2/1983 Ruggles ..... A63B 21/0004 192/93 A
4,772,015 A * 9/1988 Carlson ..... A63B 21/4047 482/902
4,858,912 A * 8/1989 Boyd ..... A63B 23/14 482/115
5,141,478 A * 8/1992 Upper ..... A63B 23/16 482/118
5,788,618 A * 8/1998 Joutras ..... A43B 1/0054 482/114
5,954,621 A * 9/1999 Joutras ..... A43B 1/0054 482/114
6,443,877 B1 * 9/2002 Hoecht ..... A63B 23/035 482/103
6,447,430 B1 * 9/2002 Webb ..... A63B 21/154 482/93
6,736,766 B1 * 5/2004 Gallant ..... A63B 21/0004 482/114
7,601,105 B1 * 10/2009 Gipson, III ..... A63B 21/055 482/103
7,608,024 B2 10/2009 Sechrest et al.
7,815,552 B2 10/2010 Dibble et al.
7,988,605 B1 * 8/2011 Wyeroski ..... A63B 21/00069 482/116
8,147,386 B2 * 4/2012 Farnsworth ..... A63B 23/1209 482/121
8,308,620 B2 11/2012 Lyszczarz
8,500,607 B2 8/2013 Vittone et al.
8,550,964 B2 10/2013 Ish, III et al.
D708,274 S * 7/2014 Eder ..... D21/673
2002/0013200 A1 * 1/2002 Sechrest ..... A63B 21/152 482/98
2003/0017918 A1 * 1/2003 Webb ..... A63B 21/154 482/94
2003/0022765 A1 * 1/2003 Wu ..... A63B 21/0051 482/92
2003/0045406 A1 * 3/2003 Stone ..... A63B 21/154 482/100
2003/0115955 A1 * 6/2003 Keiser ..... A63B 21/0087 73/379.06
2004/0018920 A1 * 1/2004 Simonson ..... A63B 21/154 482/99
2004/0142799 A1 * 7/2004 Yeo ..... A63B 21/153 482/126
2005/0124471 A1 * 6/2005 Wilkinson ..... A63B 22/0005 482/121
2007/0054785 A1 * 3/2007 Drechsler ..... A63B 21/0628 482/94
2007/0161472 A1 * 7/2007 Drechsler ..... A63B 15/00 482/100
2008/0300116 A1 * 12/2008 Eder ..... A63B 21/156 482/100
2009/0023561 A1 * 1/2009 Ross ..... A63B 21/055 482/92
2009/0036277 A1 * 2/2009 Ish, III ..... A63B 21/153 482/94
2009/0137370 A1 * 5/2009 Kushnir ..... A63B 21/00069 482/120
2009/0170668 A1 7/2009 Giannelli et al.
2010/0016129 A1 * 1/2010 Chou ..... A63B 21/156 482/97
2012/0178596 A1 * 7/2012 Vittone ..... A63B 21/151 482/99
2013/0116605 A1 * 5/2013 Dephouse ..... A63B 21/0004 601/33
2014/0121072 A1 * 5/2014 Ercanbrack ..... F16B 45/02 482/99
2014/0274600 A1 * 9/2014 Dalebout ..... A63B 21/225 482/115

* cited by examiner

PUSH ACTUATED POSITIONAL ADJUSTMENT OF STRENGTH MACHINES

RELATED APPLICATIONS

This application claims priority to provisional Patent Application No. 61/922,651 titled "Push Actuated Positional Adjustment of Strength Machines" filed Dec. 31, 2013. This application is herein incorporated by reference for all that it discloses.

BACKGROUND

While there are numerous exercise activities that one may participate in, exercise may be broadly divided into the categories of aerobic exercise and anaerobic exercise. Aerobic exercise generally refers to activities that substantially increase the heart rate and respiration of the exerciser for an extended period of time. This type of exercise is generally directed to enhancing cardiovascular performance. Such exercise usually includes low or moderate resistance to the movement of the individual. For example, aerobic exercise often includes activities such as walking, running, jogging, swimming, or bicycling for extended distances and extended periods of time.

Anaerobic exercise generally refers to exercise that strengthens skeletal muscles and usually involves the flexing or contraction of targeted muscles through significant exertion during a relatively short period of time and/or through a relatively small number of repetitions. For example, anaerobic exercise often includes activities such as weight training, push-ups, sit-ups, pull-ups, or a series of short sprints.

To build skeletal muscle, a muscle group is contracted against resistance. The contraction of some muscle groups produces a pushing motion, while the contraction of other muscle groups produces a pulling motion. A cable machine is a popular piece of exercise equipment for building those muscle groups that produce pulling motions. A cable machine often includes a cable with a handle connected to a first end and a resistance mechanism connected to a second end. A midsection of the cable is supported with at least one pulley. To move the cable, a user pulls on the handle with a force sufficient to overcome the force of the resistance mechanism. As the cable moves, the pulley or pulleys direct the movement of the cable and carry a portion of the resistance mechanism's load.

One type of cable machine is disclosed in U.S. Pat. No. 7,608,024 issued to Scott Sechrest. In this reference, a multiple exercise performance or positioning apparatus comprises a generally upright stationary frame on which is mounted an elongated arm mechanism which is mounted on a pivot mechanism, the arm mechanism extending from a proximal end to a distal end relative to the frame, the pivot mechanism enabling pivoting of the arm mechanism such that the distal end of the arm mechanism is adjustably movable between positions of variable distance away from the frame, wherein a cable mechanism is mounted around one or more pulleys, the cable mechanism having a first end interconnected to a handle mechanism which is mounted at the distal end of the elongated arm mechanism, the cable mechanism being interconnected to a weight resistance mechanism such that a user may grasp and pull the handle mechanism against an opposing force exerted by the weight resistance mechanism through the cable mechanism. Other types of cable machines are described in U.S. Pat. No. 7,815,552 issued to Ryan R. Dibble and U.S. Patent Publication No. 2009/0170668 issued to Raymond Giannelli. Each of these references is herein incorporated by reference for all that they contain.

SUMMARY

In one aspect of the invention, an exercise machine includes an adjustable joint comprising a first part and a second part that are shaped to rotate with respect to each other.

In one aspect of the invention, the exercise machine may further include that when an orientation between the first part and the second part changes a position of a user contact feature also changes.

In one aspect of the invention, the exercise machine may further include a locking mechanism positioned to secure the first part and the second part together.

In one aspect of the invention, the exercise machine may further include that the moving mechanism is positioned to secure the first part and the second part in an axial locking direction and to release the first part from the second part in an axial release direction.

In one aspect of the invention, when the first part and the second part are secured at least two first part features are interlocked with at least two second part features simultaneously.

In one aspect of the invention, the first part and the second part are connected with a central pivot shaft shaped to allow the first part and the second part to rotate about a central axis with respect to each other.

In one aspect of the invention, the locking mechanism is incorporated into the central pivot shaft.

In one aspect of the invention, the locking mechanism comprises a spring that forms a spring force in the axial locking direction.

In one aspect of the invention, the at least two first part features are protrusions and the at least two second part features are receptacles that are spaced receive the protrusions.

In one aspect of the invention, the receptacles are formed in a periphery of the second part.

In one aspect of the invention, the receptacles are formed in a face of the second part.

In one aspect of the invention, the receptacles are formed in a substantially circular arrangement.

In one aspect of the invention, the first part and the second part are plates that face one another.

In one aspect of the invention, the locking mechanism incorporates a cam assembly.

In one aspect of the invention, the second part features are grooves that are formed along a width of the second part.

In one aspect of the invention, the locking mechanism is arranged to release the first part in response to a pushing action by a user.

In one aspect of the invention, the adjustable joint is formed in a mechanical linkage that connects a resistance mechanism to a user contact feature.

In one aspect of the invention, the mechanical linkage between the resistance mechanism and the user contact feature are connected with a cable that is routed through the adjustable joint.

In one aspect of the invention, the axial locking direction is aligned with a pull force generated when a user pulls against the resistance mechanism.

In one aspect of the invention, the exercise machine may further include a mechanical linkage that connects a resistance mechanism to the user contact feature.

In one aspect of the invention, the adjustable joint comprises a first plate and a second plate that are connected with a central pivot shaft shaped to allow the first plate and the second plate to rotate with respect to each other such that when an orientation between the first plate and the second plate changes a position of the handle also changes.

In one aspect of the invention, the exercise machine may further include a locking mechanism positioned to move at least one of the first plate and the second plate.

In one aspect of the invention, the locking mechanism is positioned to secure the first plate and the second plate in an axial locking direction and to release the first plate from the second plate in an axial release direction.

In one aspect of the invention, when the first plate and the second plate are secured at least two protrusions of the first plate are inserted into at least two receptacles of the second plate simultaneously.

In one aspect of the invention, the mechanical linkage between the resistance mechanism and the handles are connected with a cable that is routed through the adjustable joint.

In one aspect of the invention, the locking mechanism comprises a spring that forms a spring force in the axial locking direction.

In one aspect of the invention, the locking mechanism is arranged to release the first part in response to a pushing action by a user.

In one aspect of the invention, the exercise machine may further include a mechanical linkage that connects a resistance mechanism to at least one handle.

In one aspect of the invention, the mechanical linkage includes a cable that is routed through an adjustable joint.

In one aspect of the invention, the adjustable joint comprises a first plate and a second plate that are connected with a central pivot shaft shaped to allow the first plate and the second plate to rotate with respect to each other such that when an orientation between the first plate and the second plate changes, a position of the at least one handle also changes.

In one aspect of the invention, the exercise machine may further include a locking mechanism that is arranged to move at least one of the first plate and the second plate.

In one aspect of the invention, the locking mechanism is positioned to secure the first plate and the second plate in an axial locking direction and to release the first plate from the second plate in an axial release direction.

In one aspect of the invention, the locking mechanism comprises a spring that forms a spring force in the axial locking direction.

In one aspect of the invention, when the first plate and the second plate are secured at least two protrusions of the first plate are inserted into at least two receptacles of the second plate simultaneously.

Any of the aspects of the invention detailed above may be combined with any other aspect of the invention detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

Building muscle can be enhanced by varying the angle at which a weight a moved. For example, on a cable machine, a different group of muscles is worked when the user is pulling the cable upwards verses pulling the cable downwards. Likewise, a user can target different muscles groups when the user varies the vertical height of the user's arms. For example, the user can grip a handle bar by positioning the right end of the handle bar to a higher position than a left end of the handle bar. As the user pulls back the user's muscles worked on the right side may be different than a group of muscles worked on the left side of the user. The user can switch the vertical heights of the handle bar's ends such that the left end of the handle bar is positioned to the height previously occupied by the right end of the handle bar. Likewise, the right end of the handle bar can be positioned to the vertical height previously occupied by the left end of the handle bar. As the user pulls the handle bar back with the right end higher than the left end against a force generated by the resistance mechanism, the user works the corresponding different muscle groups.

The principles described in the present disclosure provide a quick and efficient mechanism to change an angle of a handle bar without causing the user to manually remove a pin, rotate the handle bar, and reinsert the pin while maintaining the handle bar in the desired angle. Such principles allow the user to merely push a cross bar away from the user to release the cross bar from a secured state, rotate the cross bar to a desired angle while the cross bar is released, and return the cross bar to the secured state when the cross bar is at the desired angle.

For the purposes of the present disclosure, the term "locking direction" is any appropriate direction of the movement of either the first part or the second part of the locking mechanism that causes the first part and the second part to be secured to one another. For the purposes of the present disclosure, the term "release direction" is any appropriate direction of the movement of either the first part or the second part of the locking mechanism that causes the second part to be free from the first part.

For purposes of the present disclosure, the term "user contact feature" may include any feature that may come into contact with a user to operate the exercise machine. Such a user contact feature may include, but is not limited to handles, cross bars, press bars, back supports, legs grips, hand grips, pads, other types of user contact features, or combinations thereof. Further, for purposes of the present disclosure, the term "mechanical linkage" may include any appropriate type of linkage that connects the user contact feature with the resistance mechanism. Such mechanical linkages include cables, arms, cross bars, rods, other types of mechanical linkages, or combinations thereof.

Figure 1:
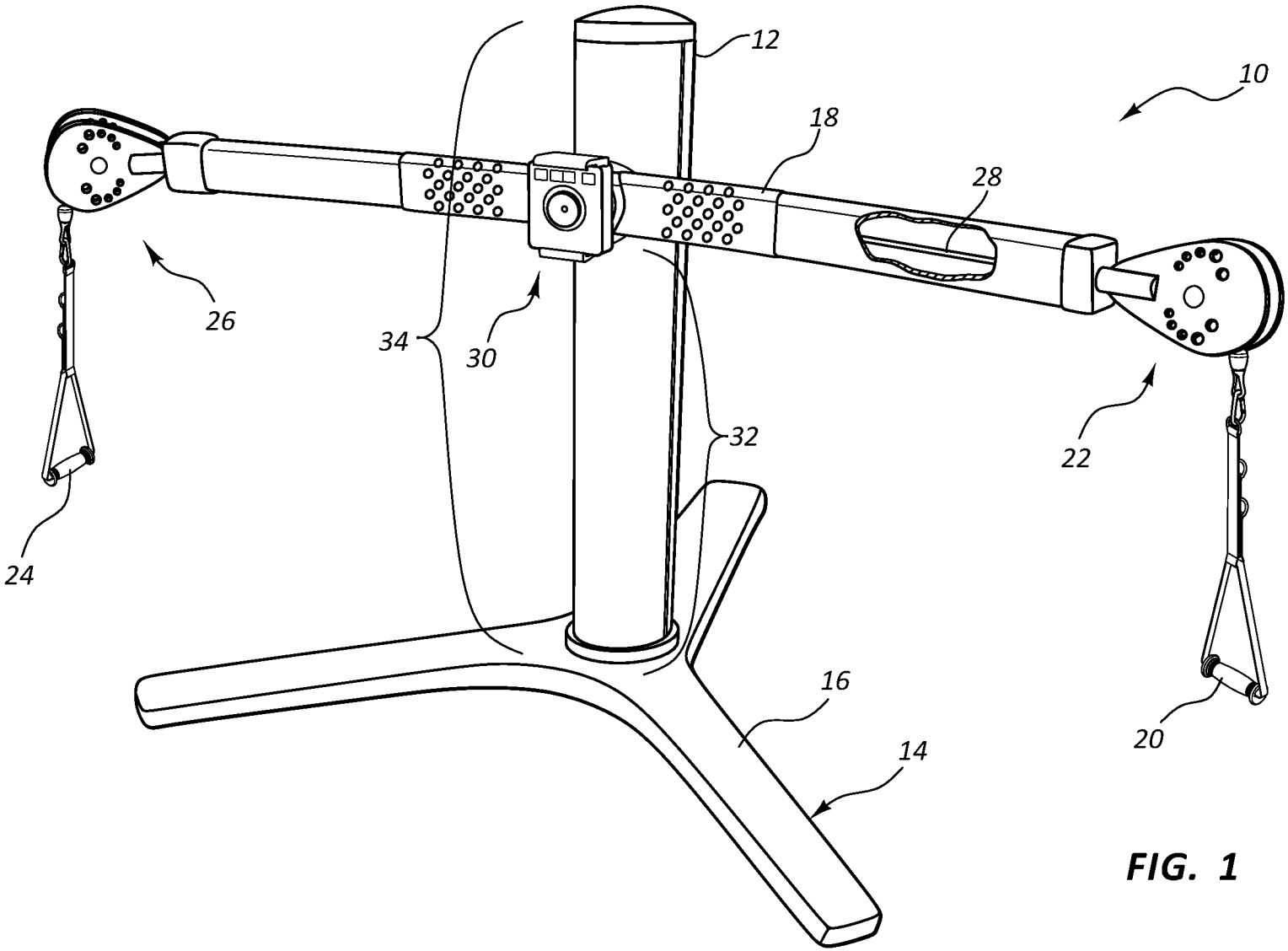
FIG. 1 illustrates a front perspective view of an example of an exercise machine in accordance with the present disclosure.
Figure 2:
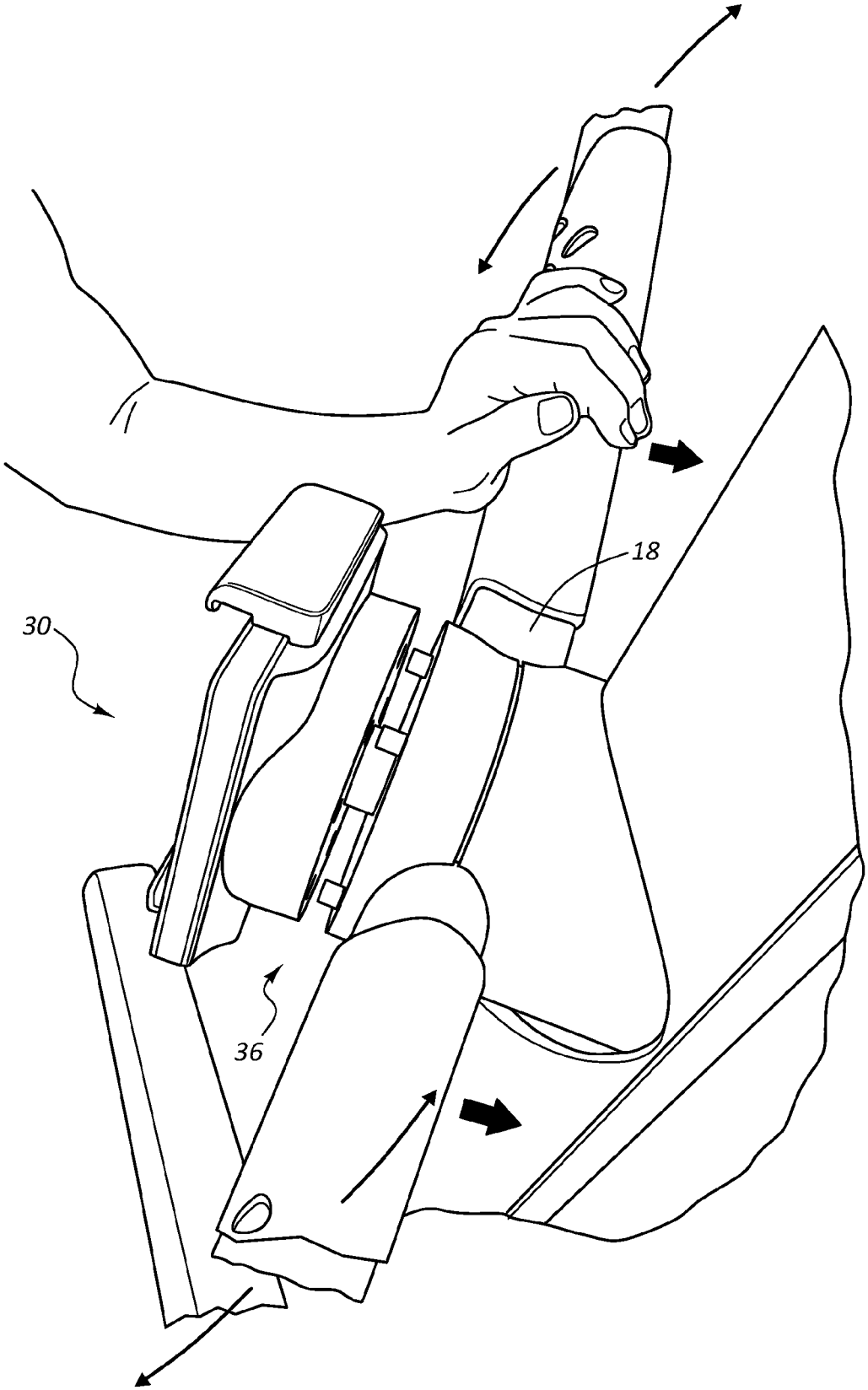
FIG. 2 illustrates a close up view of an adjustable joint of the exercise machine of FIG. 1.

Particularly, with reference to the figures, FIGS. 1-2 depict a pull exercise machine 10 that includes a tower 12 supported by a base 14. In the example of FIGS. 1-2, the base includes three legs 16. However, any number of legs may be used in accordance with the present disclosure. A cross bar 18 is connected to the tower 12. A first handle 20 is connected to a first end 22 of the cross bar 18, and a second handle 24 is connected to a second end 26 of the cross bar 18. Each handle 20, 24 is connected to a cable 28 that is routed through or otherwise supported by the cross bar 18 to a resistance mechanism that is supported by the tower 12.

As the user pulls on the handles 20, 24, the cable 28 moves against a force generated by the resistance mechanism, which resists cable movement. The resistance mechanism may be integrated into a cavity formed in the tower 12 or the resistance mechanism may be attached to an outside surface of the tower 12. In some examples, the resistance mechanism is a magnetic resistance mechanism. In other examples, the resistance mechanism includes a stack of weights. In yet other examples, the resistance mechanism includes a pulley resistance type mechanism, a flywheel resistance mechanism, a braking mechanism, an elastomeric resistance mechanism, another type of resistance mechanism, or combinations thereof.

The cross bar 18 may be attached to the tower 12 at an adjustable joint 30. In some examples, the height 32 of the cross bar 18 is adjustable. The height 32 of the cross bar 18 may be adjusted by sliding the cross bar 18 along a length 34 of the tower 12. Any appropriate type of mechanism may be used to slidably lock or slidably release the cross bar 18 from the tower 12 to adjust the cross bar's height 32. For example, a screw clamp, release button, or another mechanism may be used to adjust the height 32 of the cross bar 18.

The azimuth of the cross bar 18 may also be adjusted. The adjustable joint 30 may include a locking mechanism 36 that provides an easy and convenient mechanism for adjusting the azimuth of the cross bar. In the examples of FIGS. 1-2, the cross bar 18 is positioned such that the cross bar 18 is perpendicular to the tower 12. However, the adjustable joint 30 may allow the cross bar to be adjusted to any appropriate azimuthal position. Appropriate azimuthal positions may include rotating the cross bar 18 to be substantially parallel with the tower 12. In other examples, the cross bar 18 and the tower 12 may form an angle between zero and 90 degrees. In examples where the cross bar 18 is substantially perpendicular with the tower 12, the handles 20, 24 at the first and second ends 22, 26 of the cross bar 18 will be at approximately the same height. However, when the cross bar 18 and the tower 12 form any angle that is different than 90 degrees, the height of the first and second handles 20, 24 will be different providing the user an advantage of working targeted muscle groups.

Figure 3:
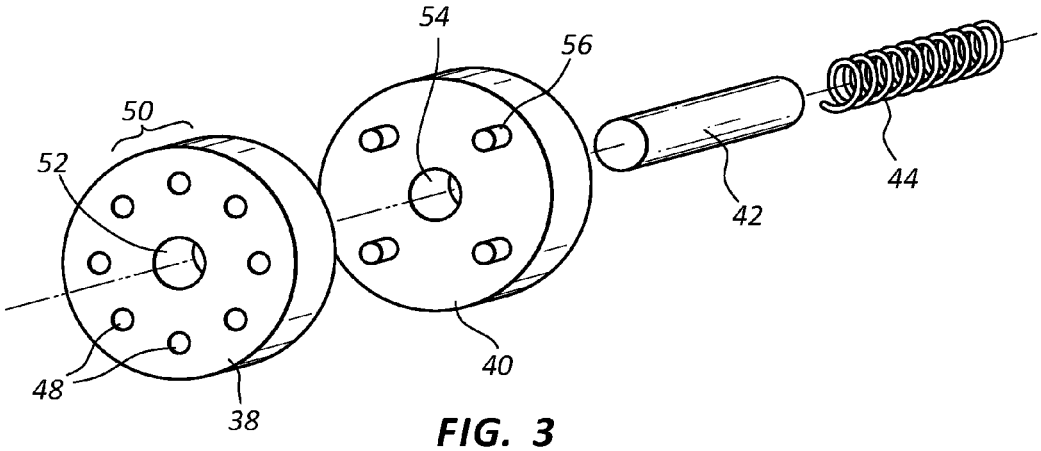
FIG. 3 illustrates an exploded view of the adjustable joint of FIG. 1.

FIG. 3 illustrates an exploded view of the adjustable joint of FIG. 1. In this example, the locking mechanism 36 of the adjustable joint 30 has a first plate 38, a second plate 40, a central pivot shaft 42, and a compression spring 44. The first plate 38, second plate 40, central pivot shaft 42, and the compression spring 44 share a common central axis 46. The first plate 38 and the second plate 40 are loaded onto the central pivot shaft 42. The compression spring 44 is also loaded onto the central pivot shaft 42 such that the compression spring 44 pushes the second plate 40 towards the first plate 38.

The first plate 38 includes multiple features, such as receiving holes 48 that are formed through the thickness 50 of the first plate 38. The second plate 40 also includes a central hole 52 such that the first plate 38 can be connected to the central pivot shaft 42. The first plate 38 may be rigidly secured to the central pivot shaft 42 with a weld, a fastener, a thread form, or another type of rigid connection. In alternative examples, the first plate 38 is integrally formed with the central pivot shaft 42 and are a single piece. The holes 48 formed in the first plate 38 are arranged in any appropriate arrangement. In the example of FIG. 3, the holes 48 are arranged such that they are spaced equidistance from one another near the periphery of the first plate 38.

The second plate 40 also has another central hole 54 to receive the central pivot shaft 42. The central hole 54 of the second plate 40 is shaped such that the second plate can rotate around the central pivot shaft 42 about the central axis 46. The second plate 40 includes multiple features, such as protrusions 56 that are spaced to be inserted into at least some of the holes 48 formed in the first plate 38. In some examples, there is a corresponding protrusion 56 of the second plate 40 for each of the holes 48 in the first plate 38. In alternative examples, there are just two or more protrusions 56 that can be inserted into the holes 48 of the first plate 38. The arrangement of the holes 48 of the first plate 38 and the protrusions 56 of the second plate 40 are such that the second plate 40 can be situated in multiple azimuthal positions about the central pivot shaft 42 and/or central axis 46 with respect to the first plate 38 when the protrusions 56 are inserted into the holes 48.

The second plate 40 is attached to the cross bar 18. As the angular position of the cross bar 18 changes based on the user's preferences, the movement of the cross bar 18 will change the position of the second plate 40 when the second plate's protrusions 56 are not inserted into the holes 48 of the first plate 38. When the protrusions 56 are inserted into the first plate's holes 48, the rotational orientation of the cross bar 18 with respect to the first plate 38 is fixed. Thus, for a user to change the azimuth of the cross bar 18 with respect to the first plate 38, the user may move the cross bar 18 in a direction such that the second plate 40 moves away from the first plate 38 to release the second plate 40 from the first plate 38. The user may then orient the cross bar 18 to any desired azimuthal position about the central pivot shaft 42. When the desired azimuthal position is reached, the cross bar 18 may be moved in a direction towards the first plate 38 such that the protrusions 56 of the second plate interlock with the holes 48 of the first plate 38. When the first and second plate 38, 40 are interlocked, the cross bar 18 is rotationally locked in place.

The compression spring 44 is situated about the central pivot shaft 42 such that the compression spring 44 creates a spring force that pushes the second plate 40 towards the first plate 38. With such an arrangement, the compression spring 44 causes the first plate 38 and the second plate 40 to be secured by default. However, the spring force is not strong enough that a user cannot overcome the force by pushing on the cross bar to release the second plate 40 from the first plate 38 when adjusting the cross bar's orientation.

While this example has been described with reference to a specific mechanism that urges the second plate 40 towards the first plate 38, any appropriate mechanism may be used to create a force that moves the second plate 40 along a length of the central shaft towards the first plate 38. For example, a tension spring, a suction device, gravity, another mechanism, or combinations thereof may be used to create such a force.

Further, while this example has been described with specific reference to the second plate 40 being attached to the cross bar 18, in alternative examples the cross bar 18 is attached to the first plate 38. Further, in alternative examples, the plate that moves with the cross bar 18 may include protrusions, holes, or combinations thereof.

Either the first plate 38 or the second plate 40 may have any appropriate shape. For example, the first plate may be square, rectangular, circular, another type of shape, or combinations thereof. Additionally, in some examples, either the holes 48 or the protrusions 56 are formed directly into the cross bar 18. In examples where a plate is rigidly attached to the cross bar 18, the rigid attachment may be accomplished through any appropriate manner. For example, the plate may be welded, bonded, fastened, crimped, or otherwise rigidly connected to the cross bar 18.

Figure 4:
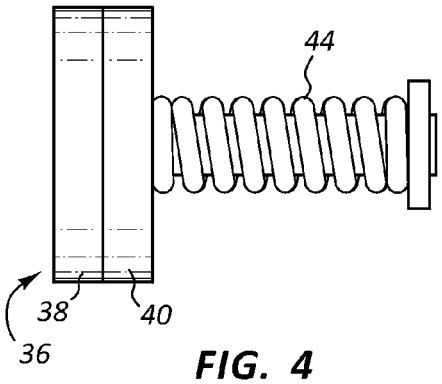
FIG. 4 illustrates a side view of an example of an adjustable joint in a secured position in accordance with the present disclosure.
Figure 5:
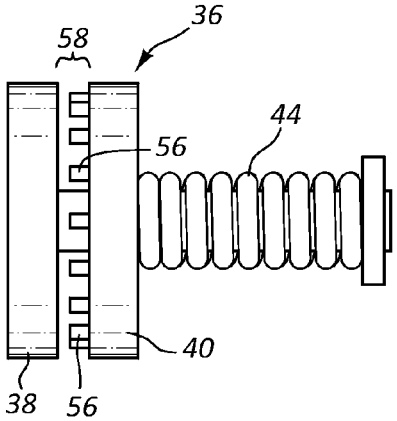
FIG. 5 illustrates a side view of an example of a locking mechanism in a released position in accordance with the present disclosure.

FIG. 4 illustrates a cross sectional view of an example of a locking mechanism 36 in a secured position in accordance with the present disclosure. In this example, the second plate 40 is pushed by the compression spring 44 into the first plate 38 such that the protrusions 56 and holes 48 interlock. FIG. 5 illustrates a cross sectional view of an example of a locking mechanism 36 in a released position in accordance with the present disclosure. In this example, there is a gap 58 between the first plate 38 and the second plate 40. The width of the gap 58 is longer than the length the protrusions 56 such that the protrusions 56 are pulled out of the holes 48 in the first plate 38.

Any appropriate type of part in the locking mechanism 36 may be used in accordance with the principles described in the present disclosure. For example, the parts of the locking mechanism 36 may include the first plate 38, the second plate 40, a cam assembly 59, a conical shaped part, a part of another shape, or combinations thereof. Further, any appropriate features of the first part 60 or the second part 68 may be used in accordance with the principles described in the present disclosure. For example, the features may be features that allow the first part 60 and the second part 68 to be secured to one another. For example, the first part 60 and the second part 68 may be interlocked with one another. Such features may include holes, grooves, recesses, protrusions, ridges, bumps, divots, edges, other types of features, or combinations thereof. Additionally, the features may be arranged on either the first part 60 or the second part 68 in any appropriate arrangement. For example, the features may be arranged in a substantially circular arrangement, a substantially triangular arrangement, a substantially square arrangement, a substantially rectangular arrangement, another type of arrangement, or combinations thereof. In some examples, each of the feature of the first part 60 mirrors features of the second part 68. However, in alternative examples, there is an unequal distribution of features between the first part 60 and the second part 68. In such examples, some of the features of either the first part 60 or the second part 68 will not be interlocked while some of the features are interlocked.

Figure 6:
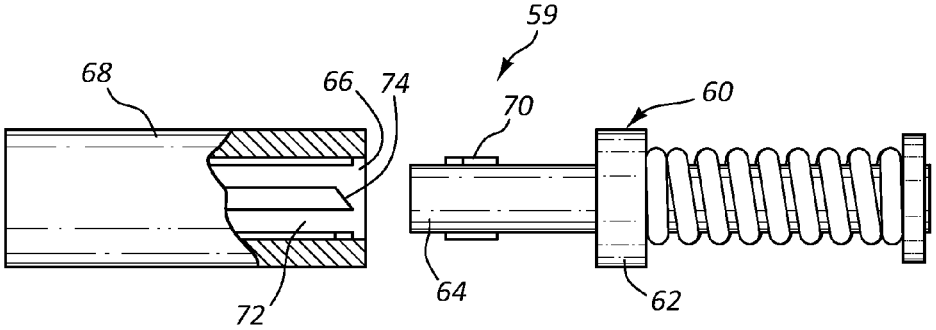
FIG. 6 illustrates a side view of an alternative example of a locking mechanism with a cam assembly in accordance with the present disclosure.

FIG. 6 illustrates a cross sectional view of an alternative example of a locking mechanism 36 incorporating a cam assembly 59 in accordance with the present disclosure. In this example, the cam assembly 59 includes a first part 60 that is spring loaded with a compression spring 44. The compression spring 44 pushes against a flange 62 of a first part 60. A protruding end 64 of the first part 60 is shaped to be received within a receptacle 66 of a second part 68 of the locking mechanism 36. The protruding end 64 includes fins 70 that are arranged to be inserted within grooves 72 of the receptacle 66. The fins 70 and the grooves 72 include ramps 74 that are shaped to create a rotary force that turns either the first part 60 or the second part 68 about a central axis 46 of the locking mechanism 36 as the protruding end 64 enters the receptacle 66.

Either the first part 60 or the second part 68 is attached to the cross bar 18. Thus, as the first part 60 and the second part 68 move linearly with respect to one another along a length of the central axis 46, either the first part 60 or the second part 68 will rotate about the central axis 46. As a result, the cross bar 18 may be rotated by linearly moving the first or second part 60, 68 with respect to one another. In some embodiments, the second part 68 is arranged so that the user may move the second part 68 back and forth to cause the cross bar 18 to rotate each time that the ramps 74 engage. In such examples, the second part 68 may be spring loaded so that the second part 68 returns to its original position after it is pushed in. Thus, the user may push the button multiple times to rotate the cross bar 18 to the desirable orientation.

Figure 7:
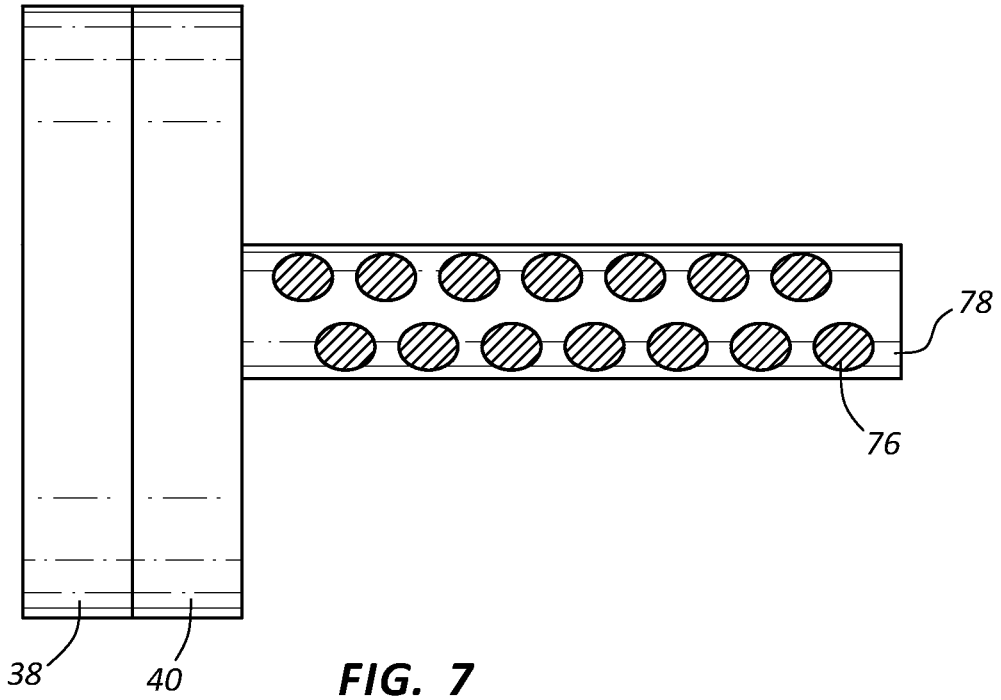
FIG. 7 illustrates a cross sectional view of an alternative example of a locking mechanism in accordance with the present disclosure.

FIG. 7 illustrates a cross sectional view of an alternative example of a locking mechanism 36 in accordance with the present disclosure. In this example, a tension spring 76 is located within a bore 78 of the central shaft. The tension spring 76 pulls on the first plate 38 to keep the first plate 38 secured to the second plate 40. By moving the first plate 38 in an axial release direction, which is away from the second plate 40, the holes 48 in the first plate 38 will be pulled away from the protrusions 56 such that either the first plate 38 or the second plate 40 are free to rotate about the central axis 46. In this example, the cross bar 18 is attached to the first plate 38. The direction that the cable moves in response to the user pulling against the resistance mechanism may be aligned with the spring force or opposing the spring force.

Figure 8:
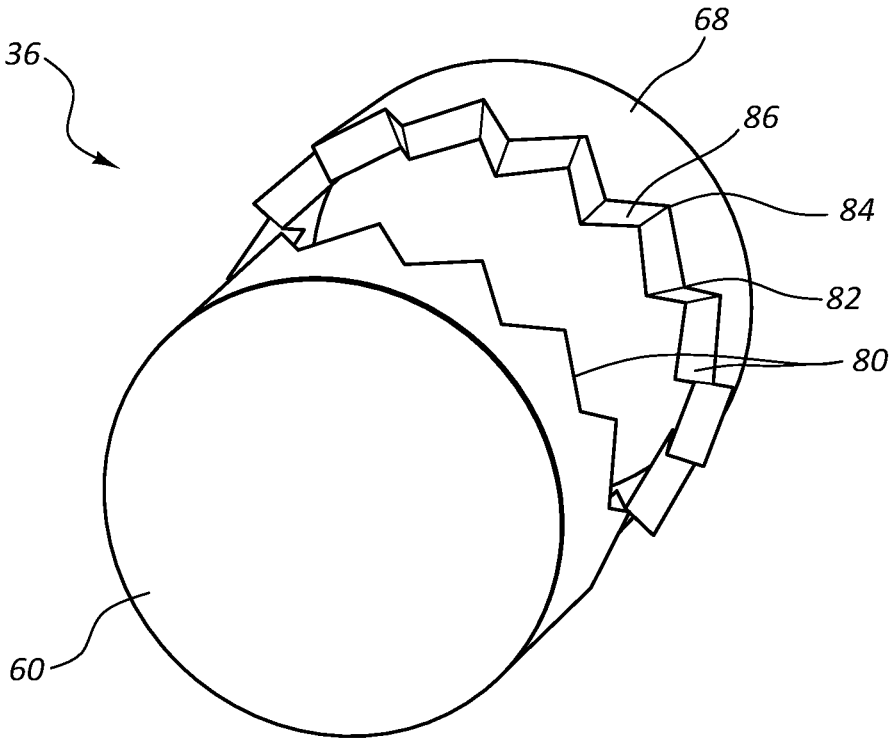
FIG. 8 illustrates a perspective view of an alternative example of a component of a locking mechanism in accordance with the present disclosure.

FIG. 8 illustrates a perspective view of an example of a component of a locking mechanism 36 in accordance with the present disclosure. In this example, the first part 60 and the second part 68 include complementary interlocking surfaces 80. Each of the complementary interlocking surfaces 80 includes crests 82 and roots 84 that are joined with inclined surfaces 86. An advantage of these types of complementary interlocking surfaces 80 is that a hole 48 of the first part, such as the first plate 38, does not have to exactly line up with a hole 48 of the second part, such as the second plate 40, when the second plate 40 is moving in the axial locking direction. In the example of FIG. 8, the orientation of the cross bar can be such that the crests 82 of the first part may be misaligned with the roots 84 of the second part 68. But, in this example, as the first part 60 and the second part 68 come together, the inclined surfaces 86 will guide the first part 60 and/or second part 68 into proper alignment.

While the example of FIG. 8 is depicted with a specific depth between the crests 82 and the roots 84, any appropriate depth may be used. For example, a shallower depth with an increased number of crests 82 and roots 84 may provide more azimuthal orientation options of the cross bar 18. On the other hand, fewer crests 82 and roots 84 with a greater depth may allow for a fewer number of azimuthal orientations that the cross bar may occupy when the first part 60 is secured to the second part 68.

Figure 9A:
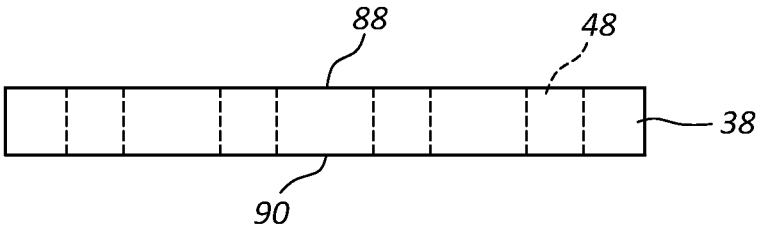
FIG. 9*a* illustrates a side view of an example of a plate of a locking mechanism in accordance with the present disclosure.
Figure 9B:
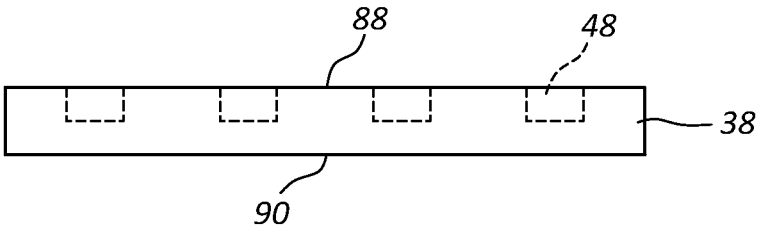
FIG. 9*b* illustrates a side view of an alternative example of a plate of a locking mechanism in accordance with the present disclosure.
Figure 9C:
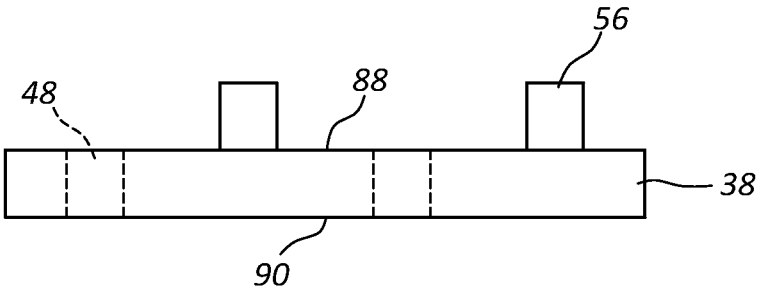
FIG. 9*c* illustrates a side view of an alternative example of a plate of a locking mechanism in accordance with the present disclosure.

FIGS. 9*a-c* illustrates side views of alternative plates of locking mechanisms in accordance with the present disclosure. In the example of FIG. 9*a*, the holes 48 in the first plate 38 will extend through the entire thickness of the first plate 38. Thus, the holes 48 are formed in both a first face 88 and a second face 90 of the first plate 38. In the example of FIG. 9*b*, the holes 48 in the first plate 38 extend through just a part of the thickness of the first plate 38. Thus, the holes 48 are formed in just the first face 88 of the first plate 38. In the example of FIG. 9*c*, the first plate 38 includes both protrusions 56 and holes 48. In such an example, the second plate 40 can include corresponding holes 48 and protrusions 56 so that the first and the second plates 38, 40 can interlock.

Figure 10A:
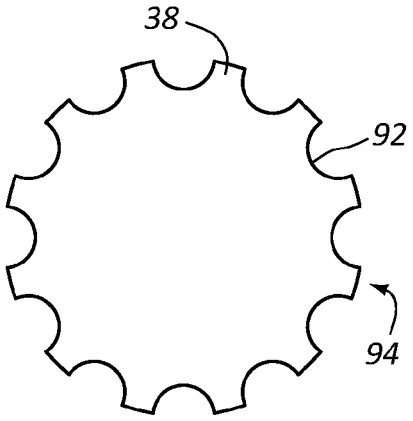
FIG. 10*a* illustrates a side view of an alternative example of a plate of a locking mechanism in accordance with the present disclosure.

FIGS. 10*a-d* illustrates side views of alternative examples of plates of locking mechanisms in accordance with the present disclosure. In the example of FIG. 10*a*, the first plate 38 includes grooves 92 that are formed in the plate's periphery 94. The grooves are spaced so that corresponding protrusions 56 of the second plate 40 will interlock with at least some of the grooves 92 when the first plate 38 and the second plate 40 come together.

Figure 10B:
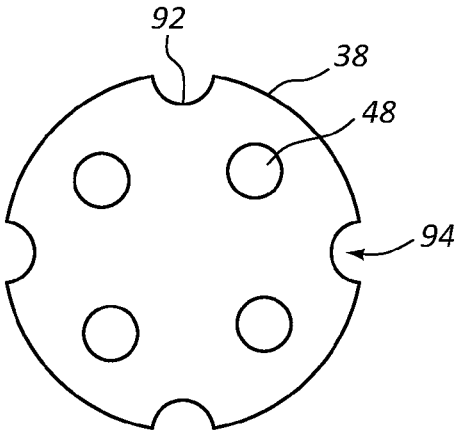
FIG. 10*b* illustrates a side view of an alternative example of a plate of a locking mechanism in accordance with the present disclosure.
Figure 10C:
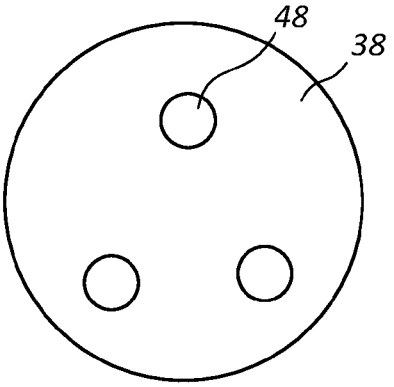
FIG. 10*c* illustrates a side view of an alternative example of a plate of a locking mechanism in accordance with the present disclosure.
Figure 10D:
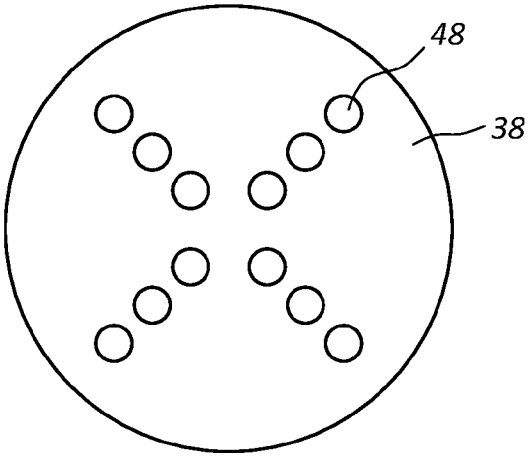
FIG. 10*d* illustrates a side view of an alternative example of a plate of a locking mechanism in accordance with the present disclosure.

In the example of FIG. 10*b*, the first plate 38 includes grooves 92 formed in the plate's periphery 94 as well as holes 48 formed near the periphery. In the example of FIG. 10*c*, the first plate 38 has just three holes 48. In such an example, there are just three azimuthal positions that the second plate 40 can occupy with respect to the first plate 38 while interlocked with the first plate 38. In the example of FIG. 10*d*, the multiple holes 48 are formed in the first plate 38 such that subsets of the holes 48 form lines that radiate out from a center of the first plate 38. In such an example, a single row of protrusions 56 may be formed in the second plate 40 and spaced to interlock with a single subset of the holes 48 formed in the first plate 38.

Figure 11:
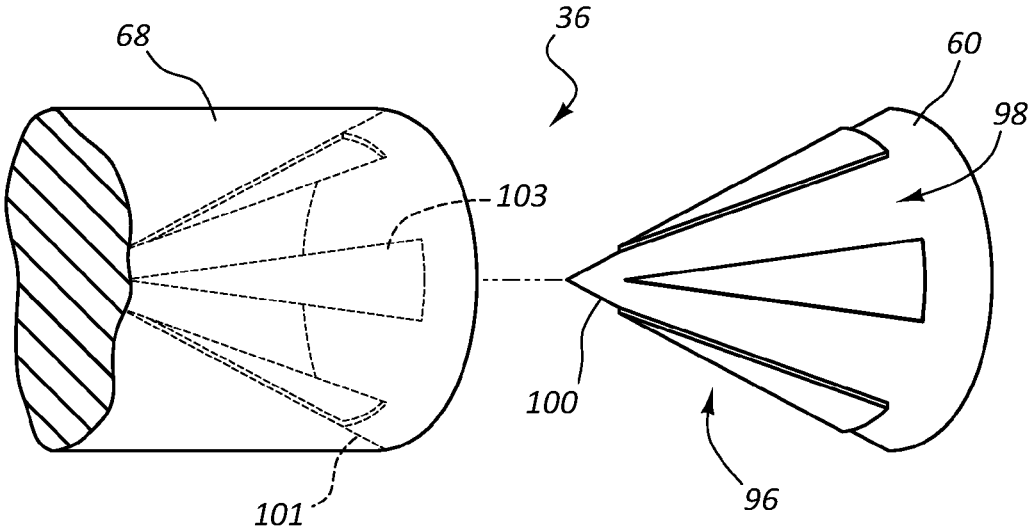
FIG. 11 illustrates a side view of an alternative example of a locking mechanism in accordance with the present disclosure.

FIG. 11 illustrates a side view of an alternative example of a locking mechanism 36 in accordance with the present disclosure. In this example, the first part 60 has a conical shape 96 and includes recesses 98 formed in a surface 100 of the conical shape 96. The second part 68 includes a receptacle 101 shaped to receive the conical shape 96 of the first part 60. Such a receptacle includes ridges 103 that interlock with the recesses 98. The first part 60 or the second part 68 can be moved in an axial release direction such that the first part 60 is released from the second part 68 to allow a user to rotate the cross bar 18 that can be attached to either the first part 60 or the second part 68.

Figure 12:
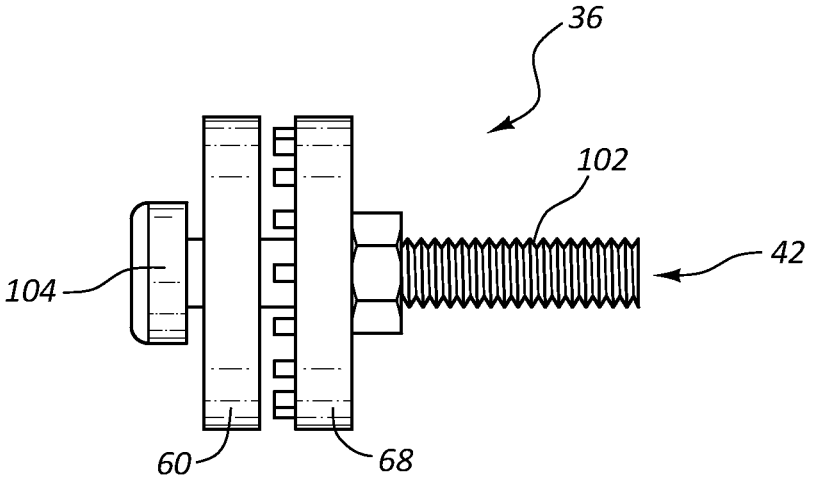
FIG. 12 illustrates a side view of an alternative example of a locking mechanism in accordance with the present disclosure.

FIG. 12 illustrates a side view of an alternative example of a locking mechanism 36 in accordance with the present disclosure. In this example, the central pivot shaft 42 includes a thread form 102. The central pivot shaft 42 also includes a handle 104 that is accessible to the user. As the user rotates the handle 104, the thread form 102 causes the second part 68 to move along the length of the central pivot shaft 42 in an axial release direction such that the first part 60 is freed from the second part 68. In such a free state, the second part 68 can be rotated about the central axis 46 of the central pivot shaft 42 such that the cross bar 18 is moved to the desired orientation. Next, the user can rotate the handle 104 in an axial reverse direction such that the second part 68 is moved in an axial locking direction so that the first part 60 can be secured to the second part 68.

Figure 13:
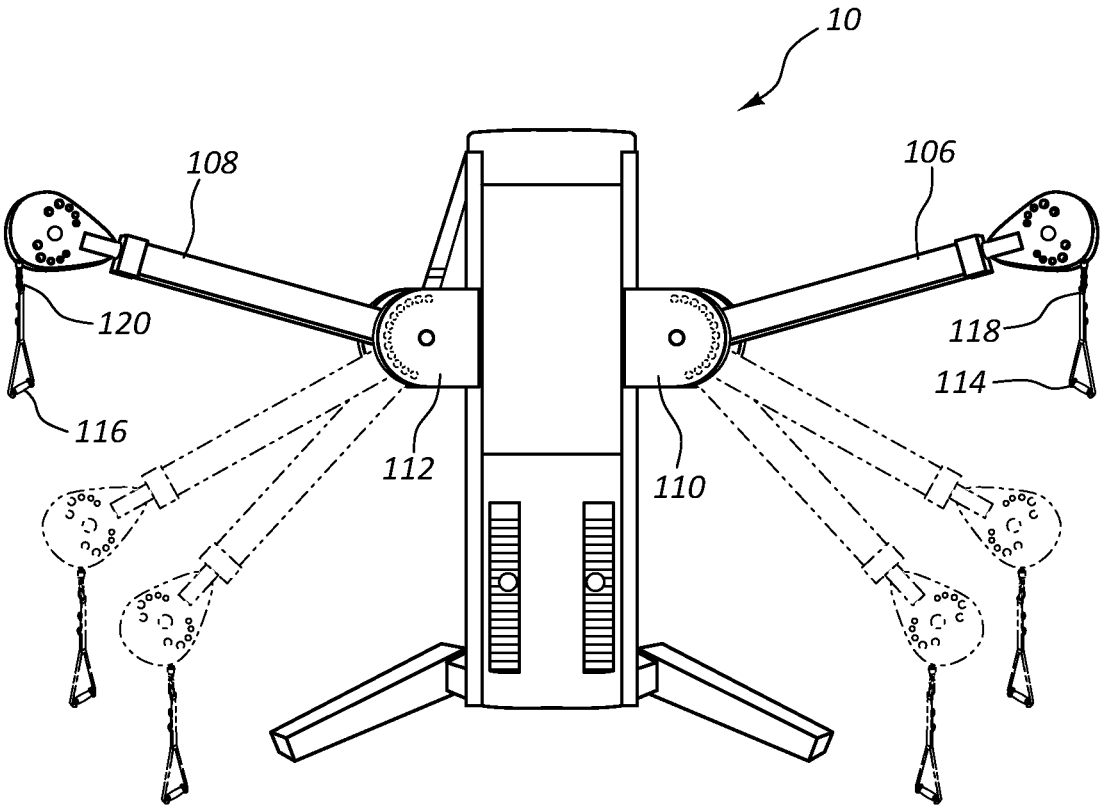
FIG. 13 illustrates a front perspective view of an example of a pull exercise machine in accordance with the present disclosure.

FIG. 13 illustrates a front perspective view of an example of a pull exercise machine 10 in accordance with the present disclosure. In this example, the pull exercise machine 10 includes a first arm 106 and a second arm 108 that move independently of each other. The first arm 106 can rotate about a shaft of a first pivot connection 110, and the second arm 108 can rotate about a shaft of a second pivot connection 112. A first handle 114 is connected to an end of the first arm 106, and a second handle 116 is connected to an end of the second arm 108. A first cable 118 is supported by the first arm 106, and a second cable 120 is supported by the second arm 108. Each of the first cable 118 and the second cable 120 is connected to resistance mechanism.

The first pivot connection 110 and the second pivot connection 112 can incorporate the first part 60 and the second part 68 as described above such that either the first arm 106 and/or the second arm 108 are connected to either the first part 60 or the second part 68. The first arm 106 and/or second arm 108 can be released by pushing the arm in a release direction. In such a released state, the first arm 106 and/or second arm 108 can be oriented to the desired azimuthal position. When the desired azimuthal position is reached, the first arm 106 and/or second arm 108 can be moved in an axial locking direction to cause the first part 60 to be secured the second part 68, and thereby secure the first arm 106 and/or second arm 108 in the desired azimuthal position.

Figure 14:
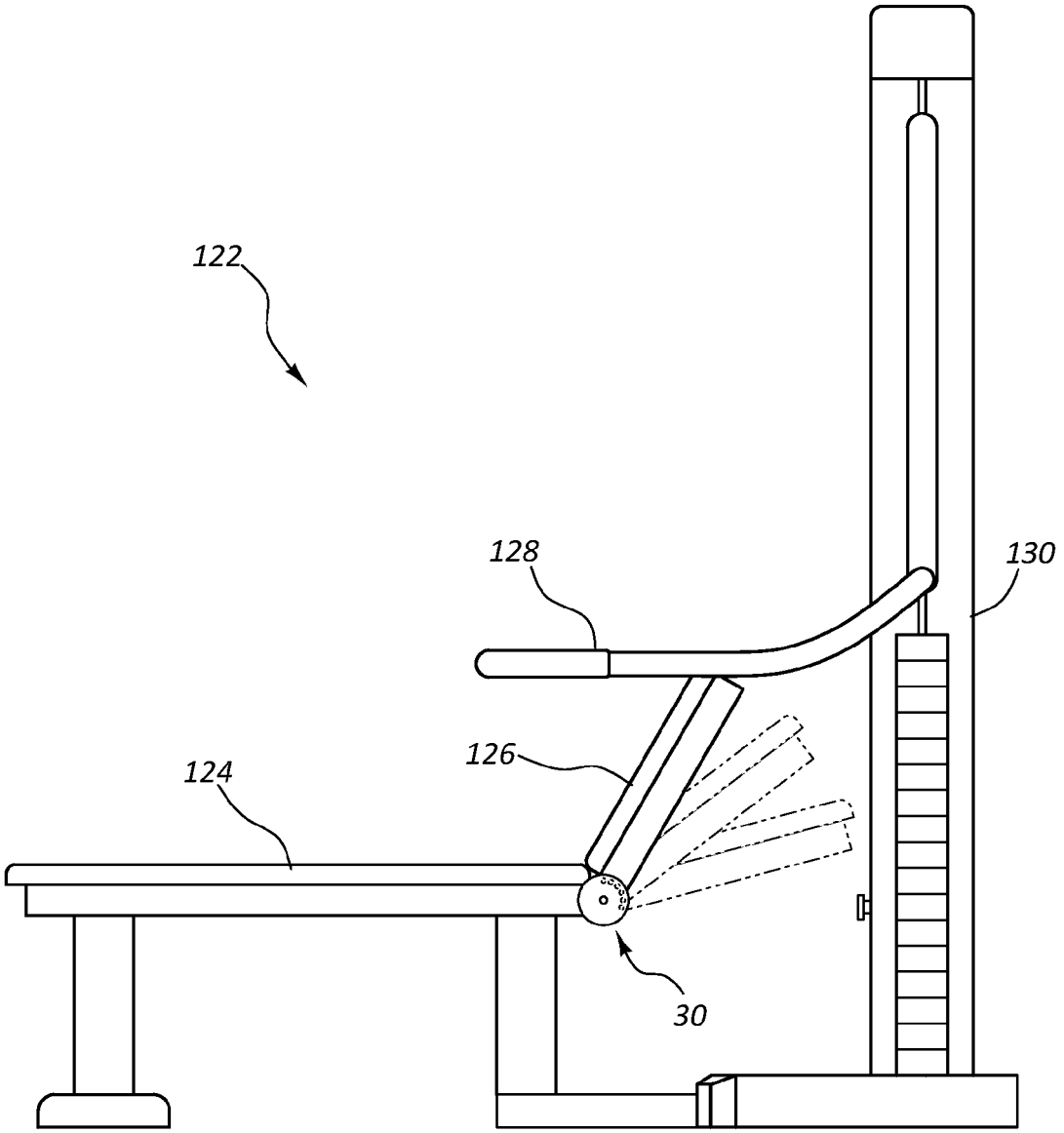
FIG. 14 illustrates a front perspective view of an example of an exercise machine in accordance with the present disclosure.

FIG. 14 illustrates a front perspective view of an example of an exercise machine 122 in accordance with the present disclosure. In this example, the exercise machine 122 includes a bench 124 with an adjustable back support 126. Further, the exercise machine 122 includes a press bar 128 for pushing a load that is supported by a vertical column 130.

The principles described in the present disclosure may be incorporated into any appropriate joint of any appropriate exercise machine. In the example of FIG. 14, the principles described in the present disclosure may be incorporated into the press bar 128 such that the angle of the press bar 128 relative to the vertical column 130 is changeable. Such angular changes in the press bar 128 may be useful for accommodating different sizes of users as well as targeting specific muscle groups.

Further, the principles described in the present disclosure may be incorporated in an adjustable joint 30 between the seat of the bench 124 and the back support 126. In such an example, the user may pull a handle, rotate a handle, press a button, use another type of mechanism, or combinations thereof to activate a release of the first part 60 from the second part 68 by moving the first part 60 or the second part 68 along a central axis. Once freed, the back support, which is rigidly connected to either the first part 60 or the second part 68, can be pivoted to a desired orientation. When the desired orientation is reached, the user may use any appropriate mechanism to cause either the first part 60 or the second part 68 to move in a locking direction so that the first part 60 is secured to the second part 68 thereby securing the back support 126 in the desired orientation.

INDUSTRIAL APPLICABILITY

In general, the invention disclosed herein may provide a user an exercise machine with the advantage of an easy and convenient mechanism for changing the angle of the machine's components. For example, the user may position the angle of a cross bar, an arm, a back support, a press bar, a cable support, a resistance mechanism, a leg press mechanism, another component, or combinations thereof to meet the user's preferences. The adjustment of such components may be beneficial to appropriately position the components of the exercise machine for the user's size and to assist the user in targeting specific muscle groups.

In some embodiments, the user can push or otherwise move the component to release the components from a secured state within another part of the exercise machine. In the freed state, the user can change the orientation of the component. When the user desires to fix the component in a particular position, the user may pull or otherwise move the component such at that the component interlocks with a part of the exercise machine.

Not all users have the same ability for changing the angle of the components of the exercise machine. For example, elderly users or users with less agility may prefer release and interlock mechanisms that able users may find tedious. Any appropriate mechanism may be used to cause the component to interlock or be released from the part. Buttons may be a convenient mechanism for some users. A push motion to release and a pull motion to interlock may be desirable for other users. In some examples, the movement of the first part 60 or the second 68 can be accomplished with motors, linear actuators, electronically controlled mechanisms, other types of mechanisms, or combinations thereof. In such examples, a user may cause the first part 60 or the second part 68 to move in either the release direction or the locking direction with controls in a control module of the machine.

Further, the first part or the second part may be spring loaded to keep the components of the adjustable joint in a locked position. For example, an entire plate with multiple protrusions may be spring loaded such that each of the protrusions of the plate move together as the plate moves. In other examples, the part with the holes, recesses, or grooves moves relative to the other part.

What is claimed is:

1. An exercise machine, comprising:

a user contact feature;

an adjustable joint including a first part and a second part, wherein the first part is shaped to rotate relative to the second part such that when an orientation between the first part and the second part changes, a position of the user contact feature changes; and a securing mechanism positioned to selectively secure the first part and the second part together;

wherein the securing mechanism is positioned to secure the first part and the second part in an axially securing direction and to release the first part from the second part in an axially releasing direction;

wherein when the first part and the second part are secured, at least two first part features are interlocked with at least two second part features simultaneously;

wherein the securing mechanism is arranged to release the first part in response to a pushing action on a mechanical linkage extending radially from opposing sides of the second part.

2. The exercise machine of claim 1, wherein the first part and the second part are connected with a central pivot shaft shaped to allow the first part and the second part to rotate about a central axis with respect to each other.

3. The exercise machine of claim 2, wherein the securing mechanism is incorporated into the central pivot shaft.

4. The exercise machine of claim 1, wherein the securing mechanism comprises a spring that forms a spring force in the axially securing direction.

5. The exercise machine of claim 1, wherein the at least two first part features are protrusions and the at least two second part features are receptacles that are spaced to receive the protrusions.

6. The exercise machine of claim 5, wherein the receptacles are formed in a periphery of the second part.

7. The exercise machine of claim 5, wherein the receptacles are formed in a face of the second part.

8. The exercise machine of claim 5, wherein the receptacles are formed in a substantially circular arrangement.

9. The exercise machine of claim 1, wherein the first part and the second part are plates that face one another.

10. The exercise machine of claim 1, wherein the securing mechanism incorporates a cam assembly.

11. The exercise machine of claim 1, wherein the at least two second part features are grooves that are formed along a width of the second part.

12. The exercise machine of claim 1, wherein the adjustable joint is formed in the mechanical linkage that connects a resistance mechanism to the user contact feature.

13. The exercise machine of claim 12, wherein the mechanical linkage that connects the resistance mechanism to the user contact feature is connected with a cable that is routed through the adjustable joint.

14. The exercise machine of claim 12, wherein the axially securing direction is aligned with a pull force generated when a user pulls against the resistance mechanism.

15. The exercise machine of claim 1, wherein the first part and the second part are restricted from rotating with respect to each other when secured and wherein the first part and the second part are free to move axially with respect to each other when not secured.

16. A pull exercise machine, comprising:

a mechanical linkage that connects a resistance mechanism to handles;

the mechanical linkage comprising an adjustable joint;

the adjustable joint comprising a first plate and a second plate that are connected with a central pivot shaft shaped to allow the first plate and the second plate to rotate with respect to each other such that when an orientation between the first plate and the second plate changes a position of the handles also changes;

a locking mechanism positioned to move at least one of the first plate and the second plate; and the locking mechanism being positioned to secure the first plate and the second plate in an axially locking direction and to release the first plate from the second plate in an axially releasing direction;

wherein when the first plate and the second plate are secured at least two protrusions of the first plate are inserted into at least two receptacles of the second plate simultaneously;

wherein the mechanical linkage extends radially from opposing sides of the second plate, and the locking mechanism is arranged to release the first plate in response to a pushing force on the mechanical linkage.

17. The pull exercise machine of claim 16, wherein the mechanical linkage that connects the resistance mechanism to the handles is connected with a cable that is routed through the adjustable joint.

18. The pull exercise machine of claim 16, wherein the locking mechanism comprises a spring that forms a spring force in the axially locking direction.

19. A pull exercise machine, comprising:

a mechanical linkage that connects a resistance mechanism to at least one handle;

the mechanical linkage including a cable that is routed through an adjustable joint;

the adjustable joint comprising a first plate and a second plate that are connected with a central pivot shaft shaped to allow the first plate and the second plate to rotate with respect to each other such that when an orientation between the first plate and the second plate changes, a position of the at least one handle also changes;

a locking mechanism that is arranged to move at least one of the first plate and the second plate;

the locking mechanism being positioned to secured the first plate and the second plate in an axially locking direction and to release the first plate from the second plate in an axially releasing direction; and the locking mechanism comprising a spring that forms a spring force in the axially locking direction;

wherein when the first plate and the second plate are secured at least two protrusions of the first plate are inserted into at least two receptacles of the second plate simultaneously;

wherein the mechanical linkage extends radially from opposing sides of the second plate, and the locking mechanism is arranged to release the first plate in response to a pushing force on the mechanical linkage.

* * * * *